US009816214B2

(12) United States Patent
Dirk et al.

(10) Patent No.: US 9,816,214 B2
(45) Date of Patent: Nov. 14, 2017

(54) ELECTROSPUN FIBER MATS FROM POLYMERS HAVING A LOW $T_m$, $T_g$, OR MOLECULAR WEIGHT

(71) Applicants: Elizabeth L Dirk, Albuquerque, NM (US); Shawn Dirk, Albuquerque, NM (US); Kirsten Cicotte, Albuquerque, NM (US)

(72) Inventors: Elizabeth L Dirk, Albuquerque, NM (US); Shawn Dirk, Albuquerque, NM (US); Kirsten Cicotte, Albuquerque, NM (US)

(73) Assignee: STC.UNM, Albuquerque, NM (US)

( * ) Notice: Subject to any disclaimer, the term of this patent is extended or adjusted under 35 U.S.C. 154(b) by 558 days.

(21) Appl. No.: 14/328,807

(22) Filed: Jul. 11, 2014

(65) Prior Publication Data

US 2014/0319740 A1 Oct. 30, 2014

Related U.S. Application Data

(62) Division of application No. 12/943,803, filed on Nov. 10, 2010, now Pat. No. 8,809,212.

(Continued)

(51) Int. Cl.

| | |
|---|---|
| ***D04H 1/728*** | (2012.01) |
| ***D01D 5/00*** | (2006.01) |
| ***D04H 1/4326*** | (2012.01) |
| ***D01D 5/38*** | (2006.01) |
| ***D01F 6/62*** | (2006.01) |

(52) U.S. Cl.

CPC ..... *D04H 1/728* (2013.01); *D01D 5/003* (2013.01); *D01D 5/0092* (2013.01); *D01D 5/38* (2013.01); *D01F 6/62* (2013.01); *D04H 1/4326* (2013.01); *D01D 5/0007* (2013.01); *D10B 2321/08* (2013.01); *Y10T 428/2915* (2015.01); *Y10T 442/60* (2015.04)

(58) Field of Classification Search

None

See application file for complete search history.

(56) References Cited

U.S. PATENT DOCUMENTS

| | | | | |
|---|---|---|---|---|
| 6,753,358 | B2 * | 6/2004 | Fisher | A61L 27/18 522/107 |
| 2006/0012084 | A1 * | 1/2006 | Armantrout | D01D 5/0985 264/465 |
| 2007/0018361 | A1 * | 1/2007 | Xu | C04B 35/62236 264/465 |

OTHER PUBLICATIONS

Wang, S. et al. Bone-Tissue-Engineering Material Poly(propylene fumarate): Corellation between Molecular Weight, Chain Dimensions, and Physical Properties, Biomacromolecules 2006, 7, 1976-1982.*

(Continued)

*Primary Examiner* — Christina Johnson
*Assistant Examiner* — Mohammad M Ameen
(74) *Attorney, Agent, or Firm* — Gonzales Patent Services; Ellen M. Gonzales

(57) ABSTRACT

Methods and apparatus for forming non-woven fiber mats from polymers and monomers that are traditionally difficult to use for fiber formation are shown and described. Applicable techniques include electrospinning and other traditional fiber formation methods. Suitable polymers and monomers include those having low molecular weight, a low melting point, and/or a low glass transition temperature.

16 Claims, 6 Drawing Sheets

Related U.S. Application Data

(60) Provisional application No. 61/280,875, filed on Nov. 10, 2009.

(56) References Cited

OTHER PUBLICATIONS

Kasper, F.K. Synthesis of Poly(Propylene Fumerarate, Nat Protoc. 2009; 45(4) 518-525.*

* cited by examiner

| | Catalyst | Reaction Temperature (°C) | % Fumerate | Tg (°C) | Mn |
|---|---|---|---|---|---|
| | TsOH | 250 | 100 | -15.24 | 473 |
| **Method A** | TsOH | 85-110 | 33 | -40.38 | 728 |
| | $H_2SO_4$ | 85-110 | 79 | -13.72 | 330 |
| | $ZnCl_2$ | 85-110 | 89 | -18.66 | 824 |
| | $FeCl_3$ | 85-110 | 87 | -37.58 | 1043 |
| **Method B** | TsOH | 50/85-110 | 55 | -13.78 | 2347 |
| | $H_2SO_4$ | 50/85-110 | 71 | -13.65 | 1739 |

Fig. 3

Top View

Side View

ELECTROSPUN FIBER MATS FROM POLYMERS HAVING A LOW $T_m$, $T_g$, OR MOLECULAR WEIGHT

CROSS-REFERENCE TO RELATED APPLICATIONS

The following application claims is a divisional of U.S. application Ser. No. 12/943,803, filed Nov. 10, 2010, which claims the benefit of U.S. Provisional Application No. 61/280,875, filed Nov. 11, 2009, each of which is hereby incorporated by reference in its entirety.

BACKGROUND

Non-woven textiles formed from polymers are useful materials for a variety of applications including, but not limited to, general textile applications and specialty applications such as scaffolding materials for tissue engineering. In scaffold design for tissue engineering applications, porosity is a significant parameter to evaluate when gauging the success of a particular scaffold because the cellular environment is crucial to cell viability and migration. Porous biomaterial structures have been formed using techniques such as three-dimensional patterning through stereolithography, phase separation, solvent casting/particulate leaching, gas foaming, and electrospinning. Electrospinning is an attractive technique for forming polymer scaffolds for tissue engineering as it produces a network of fibers of the same order of magnitude as the biological molecules found in the extracellular matrix. Furthermore, although electrospinning is a simple technique to produce fibers with nanometer to micrometer dimensions, there are many variables including solution concentration, applied voltage, needle gauge, and collector distance which influence the morphology of the produced fibers. Accordingly, electrospinning is a technique which allows for significant fine tuning of the final product, by alteration of these various factors. However, until now, it has not been possible to electrospin polymers having a low glass transition temperature ($T_g$) or low melting point ($T_m$). Furthermore, electrospinning techniques have previously only been successfully applied to polymers having a high molecular weight.

Poly(propylene fumarate) (PPF) is an unsaturated polyester which has a low melting point (it is liquid at room temperature) and which has been shown to be both biocompatible and biodegradable, having biocompatible degradation products and mechanical properties similar to bone. Because of these properties, PPF has been explored extensively as a scaffold for bone tissue engineering. PPF can be crosslinked thermally or photochemically via the fumarate carbon-carbon double bond, and accordingly, in addition to tissue engineering scaffolds, PPF has been shown to be a promising polymer to use in bone cements where the polymer is applied as a composite forming a putty-like mixture that can be hardened via crosslinking of the fumarate bond. Because PPF is liquid at room temperature, this polymer is particularly attractive for bio-engineering purposes as it can be injected, along with a leachable porogen, into an irregularly shaped defect site and crosslinked in situ. However, due to its low $T_g$ and low $T_m$, polymers like PPF have not been successfully electrospun.

Previous attempts to form fibers from polymers having low molecular weight and either a low Tg or low Tm have being entirely unsuccessful (See e.g, Song, T.; Zhang, Y. Z.; Zhou, T. J. Fabrication of magnetic composite nanofibers of poly(ε-caprolactone) with FePt nanoparticles by coaxial electrospinning. Journal of Magnetism and Magnetic Materials (2006), 303(2), e286-e289, hereby incorporated by reference). Methods that did succeed, required a high molecular weight polymer or relied on encasing the low $T_g$ polymer material in a high $T_g$ polymer—producing a hybrid material containing both high and low $T_g$ polymers or oligomers. When it was desirable to form a material consisting only of the low Tg or Tm polymer, it was necessary to perform an additional step of removing the high Tg or Tm polymer after fiber formation. (See e.g., McCann Jesse T; Marquez Manuel; Xia Younan Melt coaxial electrospinning: a versatile method for the encapsulation of solid materials and fabrication of phase change nanofibers. Nano letters (2006), 6(12), 2868-72.)

Other methodologies for electrospinning non-woven fiber mats from high molecular weight, low $T_g$ or $T_m$ polymers have relied on chemically modifying the polymer prior to electrospinning (Cashion, M. P.; Brown, R. H.; Mohns, B. R.; Long, T. E., Abstract of Papers, 238th ACS National Meeting, Washington, D.C., United States, Aug. 16-20, 2009, POLY 2009) or were successful only with rubber polymers (Choi, S. S.; Hong, J. P.; Seo, Y. S.; Chung, S. M.; Nah, C., J. Appl. Polym. Sci. 101, 2333 2006).

Accordingly, methodologies which allow for materials including oligomers and some monomers having characteristics such as low molecular weight, low $T_g$, and/or low $T_m$, which have previously made them unsuitable for electrospinning, to be formed into fibers for production of non-woven textiles are greatly desired.

SUMMARY

According to an embodiment the present disclosure provides a novel fiber production method for forming continuous sheets of non-woven textiles. According to another embodiment the present disclosure provides novel fibers and/or textiles. In certain embodiments these fibers and/or textiles are formed exclusively from polymers having a low $T_g$, low $T_m$, or low molecular weight. In other embodiments these fibers and/or textiles are formed from polymers incorporating other materials in order to produce fibers and textiles having one or more desired properties. In yet another embodiment, the present disclosure provides novel synthesis methods for low molecular weight Poly(propylene fumarate) (PPF) and Poly(propylene fumarate-co-propylene maleate) (PPFcPM).

BRIEF DESCRIPTION OF THE DRAWINGS

FIG. 3 is a table providing a summary of PPF and PPFcPM reaction conditions and polymer characterizations.

DETAILED DESCRIPTION

According to an embodiment the present disclosure provides a novel fiber production method for forming continuous sheets of non-woven textiles. While the presently described method is explained primarily in connection with electrospinning, it will be understood that the presently described method is applicable for use with a wide variety of other textile formation techniques including, but not limited to, meltblowing, melt spinning, dry spinning, wet sinning, gel spinning, single head electrospinning, multihead electrospinning, or flash spinning. Furthermore, the method is applicable for use with all spinning techniques with or without a method to preferentially orient the fibers, including, but not limited to methods that include the use of a mandrel. The method is also applicable for use with all spinning techniques with or without a method to decrease the fiber diameter, including, but limited to methods that incorporate stretching.

According to an embodiment, the fibers and textiles of the present invention are suitable for use in tissue scaffolding applications. For use as a scaffold for tissue engineering, the polymer needs to be easily processed into a highly porous scaffold with a high surface area to volume ratio and an interconnected pore network. Previous research groups have fabricated PPF scaffolds using solvent casting/salt leaching techniques. See, e.g., Porter, B. D.; Oldham, J. B.; He, S. L.; Zobitz, M. E.; Payne, R. G.; An, K. N.; Currier, B. L.; Mikos, A. G.; Yaszemski, M. J., J Biomech Eng 122, 286 2000; Hedberg, E. L.; Kroese-Deutman, H. C.; Shih, C. K.; Crowther, R. S.; Carney, D. H.; Mikos, A. G.; Jansen, J. A., Biomaterials 26, 4616 2005; and Hedberg, E. L.; Shih, C. K.; Lemoine, J. J.; Timmer, M. D.; Liebschner, M. A. K.; Jansen, J. A.; Mikos, A. G., Biomaterials 26, 3215 2005; each of which is hereby incorporated by reference. More recently, high internal phase emulsions (HIPEs) have been used. See e.g., Christenson, E. M.; Soofi, W.; Holm, J. L.; Cameron, N. R.; Mikos, A. G., Biomacromolecules 8, 3806 2007. According to an embodiment, the present disclosure provides a method of fabricating of scaffolds using the established technique of electrospinning. Electrospinning is an attractive technique for forming polymer scaffolds for tissue engineering as it produces a network of fibers of the same order of magnitude as the biological molecules found in the extracellular matrix.

Figure 1:
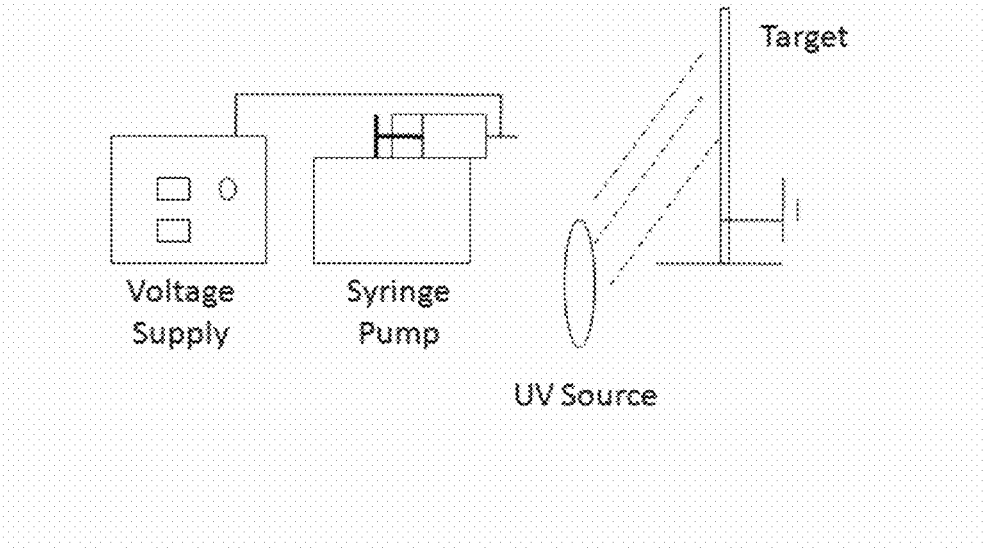
FIG. 1 is a schematic of an electrospinning setup suitable for use in the present invention.

Turning to FIG. 1, an apparatus for performing the herein described method is shown. According to this embodiment, a cross-linking agent is incorporated into the precursor polymer or oligomer solution to be electrospun. During electrospinning, the material is photo cross-linked while it is being collected on the target.

Suitable cross-linking agents include, but are not limited to, phynylbis(2,4,6-trimethylbenzoyl)-phosphine oxide (BAPO), acetophenone, 2,2-dimethoxy-2-phenylacetophenone (DMPA), benzophenone, camphorquinone, ferrocene, phenyl azide and any suitable free radical generating photoinitiator Suitable polymers and oligomers include, but are not limited to, Poly(propylene fumarate) (PPF), Poly(propylene fumarate-co-propylene maleate) (PPFcPM), Poly (butylene fumarate) (PBF), Poly(butylene fumarate-co-butylene maleate) (PBFcBM), polymers or oligomers containing terminal or pendant acrylate groups, polymers or polymers or oligomers containing terminal or pendant methacrylate groups, or other phenyl azide modified polymers. It is noted that the method described herein is particularly well suited for polymers and oligomers which were previously incapable or being electrospun including those having low $T_g$s, $T_m$s, or molecular weights. According to various embodiments and for the purposes of the present disclosure, a low $T_g$ is defined as a glass transition temperature below that of ambient room temperature, a low $T_m$ is defined as a melting point below that of ambient room temperature, and a low molecular weight is defined as a molecular weight below 10,000. In some cases the molecular weight may be lower than 10,000 such as 6000, 2000, 1000, 500 or lower. However, polymers having higher $T_g$s, $T_m$s or molecular weights are also suitable for use with the presently described methodologies. Furthermore it is noted that unlike previous methodologies wherein low $T_g$ polymers were formed into fibers by encasing them in high $T_g$ polymers, the methods of the present invention can be utilized to make fibers and, indeed, textiles formed exclusively from low $T_g$, $T_m$, or low molecular weight polymers and/or monomers.

Alternatively, rather than incorporating the cross-linking agent into the solution, the polymer (or oligomer) to be electrospun may be decorated with a photoactive moiety that enables cross-linking. Those of skill in the art will be familiar with polymer modification techniques that may be utilized to decorate polymers and oligomers. For example, polymers containing functional groups such as aldehyde, alkene, alkyne, azides, amine, carboxylic acids, cyanates, cyclic ethers, epoxy, esters, halide, hydroxyl, isocyanates, ketones, nitriles, and thiols can all be functionalized with photoactive groups. Polymers can be carbon based, ether based, ester based, urea based, or silicone based materials. Polymers can be functionalized with one or more, preferably more photoactive groups that form direct carbon-carbon bonds such as a acetylene, acrylate, cinnamate, fumarate, maleate, methacrylate, or olefinic groups with or without the addition of a photogenerated radical initiator. Alternatively, polymers or oligomers can be modified with one or more, preferably more groups that can be polymerized or cross-linked with the use of a photogenerated catalyst including both photoacid and photobase generators. Functional groups which can be photopolymerized using acid or base catalysis include groups such as cyclic ethers, cyclic ethers, and epoxy and all negative tone photoresists. Alternatively, polymers or oligomers can be modified with one or more, preferably more groups that undergo a photo-activated click reaction such as the thiol-ene, thiol-yne, photo Huisgen, or photo induced diels-alder reaction.

Furthermore, rather than, or in addition to, modifying the polymers (or oligomers) with a photoactive group, the polymers may be modified with or otherwise incorporate other desirable materials in order to produce textiles having desired physical or chemical properties or characteristics. These polymer composites may include fillers such as single-walled carbon nanotubes, multi-walled carbon nanotubes, metal based micro- or nano-particles, carbon based micro- or nano-particles, ceramic micro- or nano-particles, semiconductor micro- or nano-particles, and pharmaceutical agents.

Figure 2:
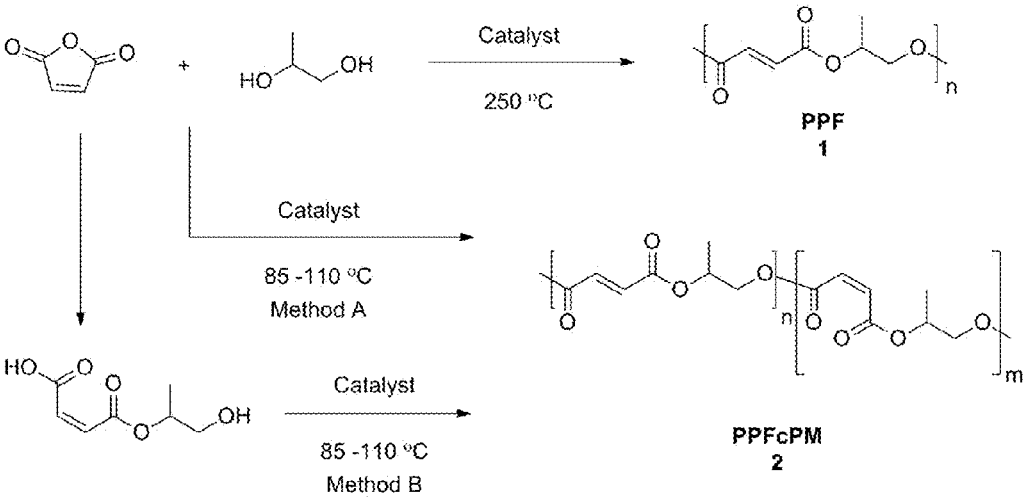
FIG. 2 depicts an exemplary synthesis scheme for the production of PPF and PPFcPM according to embodiment of the present disclosure.

As stated above, suitable polymers and oligomers include, but are not limited to, Poly(propylene fumaratefumarate) (PPF), Poly(propylene fumarate-co-propylene maleate) (PPFcPM), Poly(butylene fumarate) (PBF), Poly(butylene fumarate-co-butylene maleate) (PBFcBM). According to an embodiment, the present disclosure provides novel methods for synthesizing PPF and PPFcPM. An exemplary synthesis scheme for the production of PPF and PPFcPM is shown in FIG. 2. As described in greater detail in the Experimental section below, in scheme 1, PPF and PPFcPM are synthesized via step growth polycondensation reactions. As shown in FIG. 3, scheme 1 was performed under three different sets of conditions. The first reaction shows a high temperature synthesis where the maleate is isomerized to the fumarate. The second reaction (method A) shows the same reaction as the first one but done at a lower temperature with the use of a catalyst. The third reaction (method B) shows a low temperature ring opening reaction to make an advanced monomer that again can be polymerized via a condensation reaction in the presence of a catalyst to form the copolymer. Since the polymerization starting materials are different for method A and B the final product molecular weights and cis:trans double bond ratios are different.

All patents and publications referenced or mentioned herein are indicative of the levels of skill of those skilled in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications. The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. The methods and processes illustratively described herein suitably may be practiced in differing orders of steps, and that they are not necessarily restricted to the orders of steps indicated herein or in the claims. As used herein and in the appended claims, the singular forms "a," "an," and "the" include plural reference unless the context clearly dictates otherwise. Thus, for example, a reference to "a host cell" includes a plurality (for example, a culture or population) of such host cells, and so forth.

Under no circumstances may the patent be interpreted to be limited to the specific examples or embodiments or methods specifically disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein. In addition, where features or aspects of the invention are described in terms of Markush groups, those skilled in the art will recognize that the invention is also thereby described in terms of any individual member or subgroup of members of the Markush group.

Experiments

General Procedure. All reactions were carried out under a dry atmosphere unless noted. $^1$H nuclear magnetic resonance (NMR) was carried out on a 400 MHz Bruker DRX-AVANCE. Proton chemical shifts (δ) are reported as shifts from the internal standard tetramethylsilane (TMS). Infrared Spectroscopy (IR) was carried out on a Nicolet 6700 FTIR. Gel Permeation Chromatography (GPC) molecular weight determinations were performed by GPC using a Polymer Labs 220 PL-GPC equipped with a UV-Vis detector. Two columns (PLgel 5 μm MiniMIC-C, 250×4.6 mm) and a guard column (PLgel 5 μm MiniMIX-C, 50×4.6 mm) were used in series with a flow rate of 0.4 mL/min and a run pressure of 6.0 MPa. Chloroform was used as the eluent (0.4 mL/min), and measurements were performed at 35° C. Calibration was performed using polystyrene standards with a narrow molecular weight distribution (Fluka ReadyCal 400-2,000,000). Scanning electron microscopy (SEM) was carried out using a Zeiss Supera 55VP and a FEI DB235. Differential Scanning calorimeter (DSC) measurements, used to determine $T_g$, were performed using a TA Instruments DSC100. Viscosity determination was done using a Brookfield DV-E Viscometer, reported in cP (60 rpm, spindle #14). p-Toluensulfonic acid (TsOH), monohydrate 99%, extra pure was purchased from Acros. Ethyl acetate, HPLC grade, anhydrous magnesium sulfate ($MgSO_4$), anhydrous and sulfuric acid, certified ACS plus were purchased from Fisher. 1,2-Propanediol, 99% (PD), maleic anhydride (MA), briquettes 99%, Zinc chloride, anhydrous powder ≤99.995% trace metals, Iron (III) Chloride, reagent grade 97%, phenylbis(2,4,6-trimethylbenzoyl)-phosphine oxide, 97% and benzyl, 98% were all purchased from Aldrich. All chemicals were used as received from suppliers.

General Method A Poly(Propylene Fumarate-co-Propylene Maleate) Synthesis. MA, PD, toluene and catalyst were added to a round bottom flask equipped with stir bar and Dean-Stark (DS) trap for azeotropic distillation. The reaction was allowed to proceed at a maximum temperature of 110° C., until no more distillate (water) was collected. The reaction mixture was cooled to RT, upon cooling toluene was removed in vacuo, the crude polymer was then dissolved in ethyl acetate (EtOAc) and washed with distilled water (3×). The organic layer was then dried over anhydrous $MgSO_4$ and solvent again removed in vacuo.

General Method B Poly(Propylene Fumarate-co-Propylene Maleate) Synthesis. MA, PD and toluene were added to a round bottom flask. The reaction mixture was heated to 50° C. and stirred overnight. The reaction mixture was allowed to cool to RT and the toluene was removed in vacuo. The reaction flask was then equipped with a DS trap and condenser to collect water through azeotropic distillation during the second reaction. Next, a protic acid catalyst was added to the product of the first reaction, and the mixture heated to a maximum temperature of 110° C., until the appropriate volume of water was collected. The reaction mixture was allowed to cool to RT, the solvent was removed in vacuo, and the crude polymer was dissolved in ethyl acetate and washed with distilled water (3×). Finally, the organic layer was dried over anhydrous $MgSO_4$ and solvent removed in vacuo.

PPF Synthesis (1). MA (10.0 g, 102 mmol), PD (7.8 g, 102 mmol), and tosic acid (0.02 g, 0.1 1 mmol) was added to a 100 mL round bottom flask equipped with a stir bar and distillation head. The reaction mixture was heated to 250° C. with stirring. After 3 hrs, the reaction was allowed to cool to RT. The resulting viscous crude polymer was dissolved in ethyl acetate (50 mL) and washed with distilled water (50 mL, 3×). The organic layer was dried over anhydrous $MgSO_4$, filtered and solvent removed in vacuo to yield a slightly yellow viscous polymer. IR (neat) 2984.1, 1714.7, 1645.4, 1454.7, 1379.0, 1290.2, 1255.5, 1153.4, 1116.2, 1075.9, 1022.5, 979.1, 837.3, 753.5, 666.4 cm-1. $^1$H NMR (400 MHz, $CDCl_3$) δ 6.88-6.78 (m, —C$\underline{H}$=C$\underline{H}$—), 5.25-5.2 (m, —C$\underline{H}$($CH_3$)), 4.68-2.8 (m, —OCO—C$\underline{H}_2$—), 1.43-1.15 (m, (C$\underline{H}_3$)C$\underline{H}_2$). GPC (1 mg/mL, $CHCl_3$) Mw 949 Mn 473. $T_g$ (° C.) −15.24.

Method A PPFcPM Synthesis (2). MA (10.0 g, 102 mmol), PD (7.8 g, 102 mmol) and toluene (30-50 mL) and the appropriate catalyst, TsOH (0.2 g, 1.0 mmol), $H_2SO_4$ (1 drop, 18N), $ZnCl_2$ (0.14 g, 1.0 mmol) or $FeCl_3$ (0.17 g, 1 mmol), were added to a 100 mL round bottom flask equipped with stir bar along with DS trap and condenser. The reaction mixture was allowed to progress overnight. The reaction was ended and brought to RT, upon cooling toluene was removed in vacuo. The crude polymer was then dissolved in ethyl acetate (50 mL) and washed with water (50 mL, 3×), drying the organic phase over anhydrous $MgSO_4$ and removing the solvent to yield a viscously clear polymer.

PPFcPM synthesized with TsOH: IR (neat) 3490.0, 3058.6, 2983.4, 1711.9, 1643.6, 1455.3, 1384.2, 1252.6, 1077.7, 983.6, 828.7, 777.3 cm-1. $^1$H NMR (400 MHz, $CDCl_3$) δ 7.17-7.14 (m, Ar), 7.09-7.03 (m, Ar), 6.83-6.76 (m, trans —C$\underline{H}$=C$\underline{H}$), 6.27-6.13 (m, cis —C$\underline{H}$=C$\underline{H}$—) 5.19-5.17 (bs, —C$\underline{H}$($CH_3$)), 4.34-3.61 (m, —OCO—C$\underline{H}_2$—), 2.26 (s, C$\underline{H}_3$—Ar), 1.25-1.03 (m, (C$\underline{H}_3$)$CH_2$—). GPC (1 mg/mL, CHCl3) Mw 995 Mn 728. $T_g$ (° C.) −40.38.

PPFcPM synthesized with $ZnCl_2$: IR (neat) 3516.3, 3079.6, 2984.3, 2943.7, 2883.4, 1711.1, 1644.0, 1452.5, 1381.1, 1356.2, 1289.2, 1251.9, 1224.0, 1149.6, 1116.0, 1075.9, 1019.6, 978.3, 835.7, 773.5, 668.1 cm-1. $^1$H NMR (400 MHz, CDCl3) δ 7.22-7.20 (m, Ar), 7.14-7.10 (m, Ar), 6.90-6.76 (m, trans —C$\underline{H}$=C$\underline{H}$), 6.23-6.20 (m, cis —C$\underline{H}$=C$\underline{H}$—) 5.27-5.07 (m, —C$\underline{H}$($CH_3$)), 4.40-4.02 (m, —OCO—C$\underline{H}_2$—), 2.32 (s, C$\underline{H}_3$—Ar), 1.51-1.23 (m, (C$\underline{H}_3$)CH2-). GPC (1 mg/mL, $CHCl_3$) Mw 1297 Mn 824. $T_g$ (° C.) −18.66.

PPFcPM synthesized with $FeCl_3$: IR (neat) 3445.0, 3235.5, 3081.1, 2985.9, 2661.0, 2362.5, 1716.2, 1751.0, 1700.4, 1646.7, 1455.9, 1386.3, 1355.4, 1324.4, 1279.4, 1190.8, 1121.8, 1080.2, 990.2, 838.6, 775.3 cm-1. $^1$H NMR (400 MHz, CDCl3) δ 6.93-6.83 (m, trans —C$\underline{H}$=C$\underline{H}$), 6.33-6.23 (m, cis —C$\underline{H}$=C$\underline{H}$—) 5.27-5.10 (m, —C$\underline{H}$($CH_3$)), 4.40-4.10 (m, —OCO—C$\underline{H}_2$—), 1.44-1.23 (m, (C$\underline{H}_3$)$CH_2$—). GPC (1 mg/mL, $CHCl_3$) Mw 1871 Mn 1043. $T_g$ (° C.) −37.58.

PPFcPM synthesized with $H_2SO_4$: IR (neat) 3526.2, 3079.3, 2984.1, 1716.1, 1645.5, 1558.5, 1541.9, 1508.1, 1456.2, 1379.8, 1253.1, 1217.4, 1150.1, 1113.8, 1074.7, 977.1, 833.2, 773.2 cm-1. $^1$H NMR (400 MHz, CDCl3) δ 7.23-7.20 (m, Ar), 7.15-7.10 (m, Ar), 6.88-6.82 (m, trans —C$\underline{H}$=C$\underline{H}$), 6.34-6.24 (m, cis —C$\underline{H}$=C$\underline{H}$—) 5.24 (bs, —C$\underline{H}$($CH_3$)), 4.77-4.00 (m, —OCO—C$\underline{H}_2$—), 2.32 (s, C$\underline{H}_3$—Ar), 1.44-1.21 (m, (C$\underline{H}_3$)$CH_2$—). GPC (1 mg/mL, $CHCl_3$) Mw 672 Mn 330. $T_g$ (° C.) −12.86.

Method B PPFcPM Synthesis (2). MA (10.0 g, 102 mmol), PD (7.8 g, 102 mmol) and toluene (15 mL) were added to a 100 mL round bottom flask equipped with a stir bar. Under a nitrogen blanket, the reaction heated to 50° C. with stirring was allowed to run overnight. The next day, the reaction mixture was allowed to cool to RT and the solvent removed in vacuo. The reaction flask was then equipped with a DS trap and condenser. To the product of the first reaction, toluene and either tosic acid (0.2 g, 1 mmol) or sulfuric acid (1 drop, 18 N) was added. The reaction was allowed to run until 1.6 mL of water was collected via the DS trap. The reaction was allowed to come to RT and the solvent was removed in vacuo. The crude polymer was then dissolved in ethyl acetate (50 mL) and washed with water (50 mL, 3×). The organic layer was dried over $MgSO_4$ with filtration and the solvent was removed in vacuo to yield a slightly yellow viscous polymer.

PPFcPM synthesized with TsOH: IR (neat) 2985.9, 1721.6, 1691.3, 1644.4, 1454.6, 1381.1, 1289.9, 1252.0, 1215.8, 1152.4, 1116.1, 1075.4, 979.0, 838.2, 774.3, 736.5, 669.0 cm-1. $^1$H NMR (400 MHz, CDCl3) δ 6.86-6.83 (m, trans —C$\underline{H}$=C$\underline{H}$—), 6.29-6.23 (m, cis —C$\underline{H}$=C$\underline{H}$—), 5.24 (bs, —C$\underline{H}$($CH_3$)), 4.78-3.44 (m, —OCO—C$\underline{H}_2$), 1.32-1.17 (m, (C$\underline{H}_3$)$CH_2$—). GPC (1 mg/mL, $CHCl_3$) Mw 11388 Mn 2347. $T_g$ (° C.) −13.78.

PPFcPM synthesized with $H2SO_4$: IR (neat) 2985.7, 1717.7, 1643.6, 1454.7, 1382.5, 1253.8, 1151.8, 1116.5, 1075.3, 978.7, 889.8, 838.1, 7775.0, 734.6, 694.8 cm-1. $^1$H NMR (400 MHz, $CDCl_3$) δ 7.24-7.21 (m, Ar), 7.16-7.11 (m, Ar), 6.83 (s, trans —C$\underline{H}$=C$\underline{H}$—), 6.25 (s, cis —C$\underline{H}$=C$\underline{H}$—) 5.26 (bs, —C$\underline{H}$($CH_3$)), 4.78-2.75 (m, —OCO—C$\underline{H}_2$—), 2.33 (s, C$\underline{H}_3$—Ar), 1.33-1.17 (m, (C$\underline{H}_3$)CH2-). GPC (1 mg/mL, $CHCl_3$) Mw 5520 Mn 1739. $T_g$ (° C.) −13.78

General Procedure for Electrospinning. All polymer solutions were delivered at a constant rate via a syringe pump (KD scientific, model 100s); through a syringe fitted with stainless steel blunt tip needle (Small Parts, Inc.). The needle was charged through a high voltage supply (Glassman High Voltage, Inc. Series EL), and the resulting polymer fibers were collected on a grounded target (6×6 $in^2$ Cu plate fitted with Al foil). A UV source (UVP, Blak-Ray longwave ultraviolet lamp, model B100AP, λ=365 nm) was used to crosslink polymer solution in-situ (FIG. 2).

Electrospinning PPF and PPFcPM. A 2 mL plastic syringe (inner diameter (ID)=4.64 mm) equipped with a 20 gauge (g)×1.5 in. stainless steel blunt tip needle was used to deliver solutions of polymer dissolved in chloroform (40, 50 and 60 wt %) at a volumetric flow rate of 0.2 mL/hr and a voltage difference of 1 kV/cm from needle tip to collection plate.

Crosslinking While Electrospinning PPF and PPFcPM. A 2 ml plastic syringe (ID=4.64 mm) equipped with a 20 g×1.5 in stainless steel blunt tip needle was used to deliver a 50 wt % polymer solution with a 3 wt % initiator (benzil or phenylbis(2,4,6-trimethylbenzoyl)-phosphine oxide (BAPO)) in chloroform. The polymer solution was spun at a constant rate of 0.1 mL/hr and a voltage of 1 kV/cm, from needle tip to collection plate. While the polymer was being collected on the target it was being crosslinked via the UV source.

Crosslinked PPFcPM: IR (neat) 2957.6, 1719.1, 1643.6, 1453.2, 1382.9, 1254.2, 1209.4, 1150.8, 1114.3, 1073.3, 978.7, 813.9, 752.7, 667.5 $cm^{-1}$.

Results and Discussion

Poly(propylene-fumarate) (PPF) and poly(propylene fumarate)-co-(propylene maleate) (PPFcPM) were synthesized via step growth polycondensation reactions (FIG. 2). The glass transition temperatures of all polymers synthesized were below room temperature and ranged from −13° C. to −40° C. (FIG. 3). PPF was synthesized via the protic acid catalyzed neat reaction of maleic anhydride with 1,2-propanediol at high temperatures (~250° C.), whereas the copolymer PPFcPM was obtained using a protic acid catalyst at lower temperatures (~85-110° C.). Two different methods were explored to synthesize the copolymer.

The first method (Method A) used to synthesize the copolymer involved a protic acid or Lewis acid catalyzed polymerization reaction carried out at 85° C. to 110° C. to azeotropically remove water. The second method (Method B) involved an initial ring opening reaction carried out at 50° C. without the use of a catalyst followed by an acid catalyzed condensation reaction in combination with azeotropic removal of water.

Figure 4:
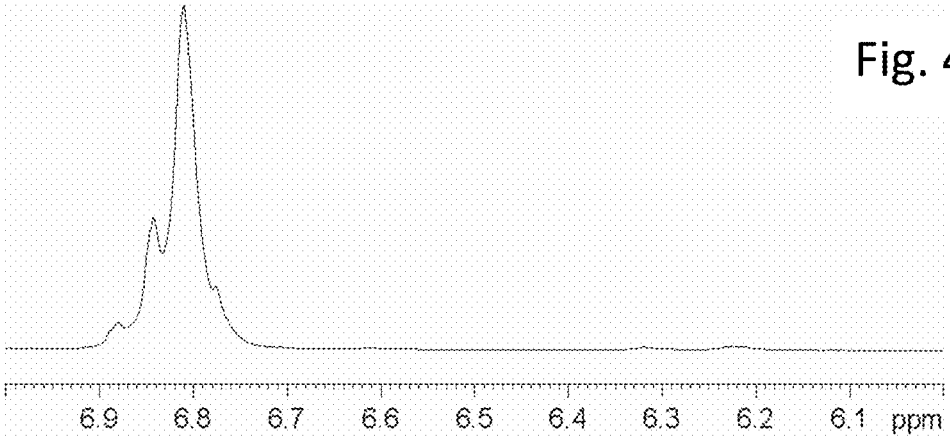
FIG. 4 depicts $^1$H NMR of PPF polymer.
Figure 5:
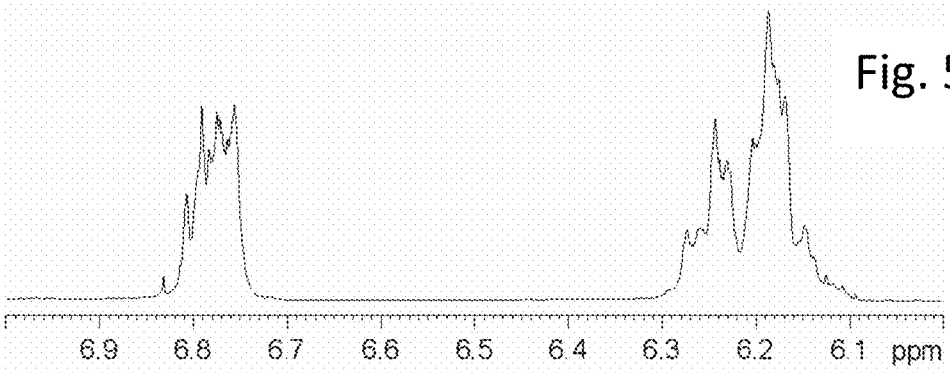
FIG. 5 depicts $^1$H NMR of PPFcPM polymer formed using Method A as described herein. The peak at 6.8-6.9 ppm corresponds to fumerate where the peak at 6.2-6.3 ppm represents the maleate.
Figure 6:
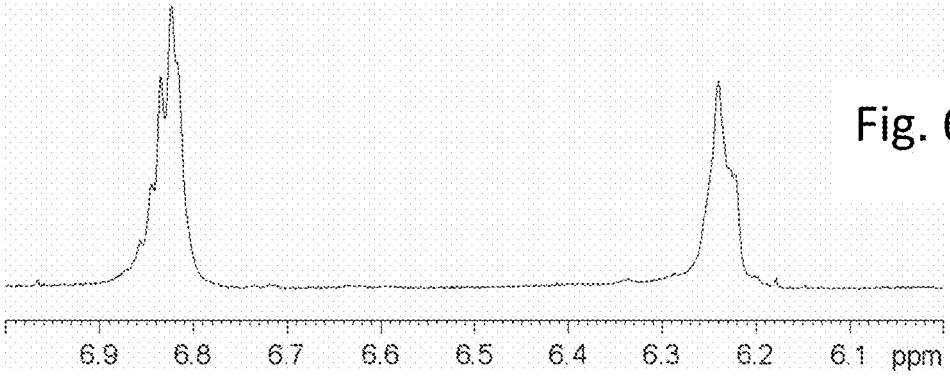
FIG. 6 depicts $^1$H NMR of PPFcPM polymer formed using Method B as described herein. The peak at 6.8-6.9 ppm corresponds to fumerate where the peak at 6.2-6.3 ppm represents the maleate.

The ratio of fumarate to maleate in the polymer was influenced by both temperature and catalyst (FIG. 3). Polymer synthesized at high temperatures (neat) produced only PPF however the molecular weight was low presumably due to side reaction products which changed the monomer stoichiometry. Since the catalytic activities of each catalyst are slightly different we can only directly compare polymerizations techniques using the same catalyst. For example, polymer synthesized at low temperatures according to Method A using TsOH yielded a polymer with 33% fumarate, whereas Method B yielded polymer that contained 55% fumarate (FIGS. 4-6). Polymer formed with mostly maleate had a very low $T_g$ when compared to polymer having a much smaller amount of maleate. Furthermore, there appears to be no correlation between $T_g$ and molecular weight as each polymer is a random copolymer.

PPFcPM synthesized using sulfuric acid as the catalyst resulted in toluene inclusion due to Friedel-Craft alkylation. See e.g, Ipatieff, V. N.; Corson, B. B.; Pines, H., J. Am. Chem. Soc. 58, 919 1936, which is hereby incorporated by reference. The influence of temperature and catalyst was also observed in all of the one step azeotropic distillation scenerios, thus providing a system which has the ability to be adjusted.

Figure 7:
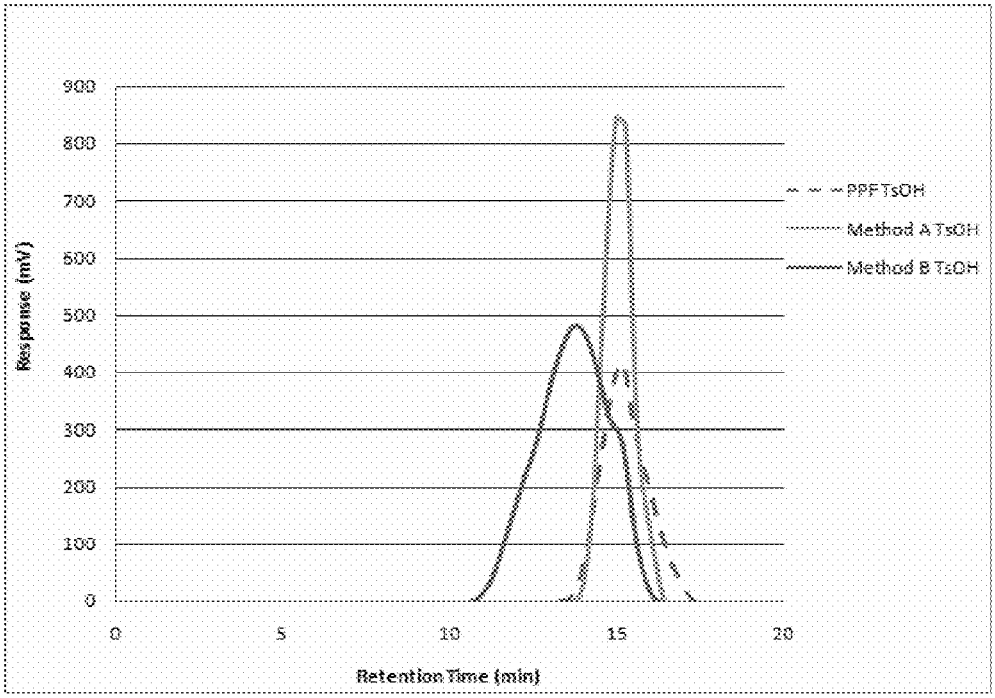
FIG. 7 depicts the GPC results, showing elution times of the PPfcPM polymer using the protic acid catalyst TsOH.

The molecular weights of all polymers produced were determined through gel permeation chromatography using narrow weight distribution polystyrene as the standards. PPF synthesized according to Method A had an average molecular weight (Mn) of 720, with poly dispersity (PDI) of 2.0. The molecular weight did not increase with longer reaction times (data not shown). The low molecular weight is consistent with the initial production of PPFcPM oligomers which thermally isomerizes to the more stable fumarate form. Presumably the high temperature results in both isomerization and side reactions that limit the polymer molecular weight by changing the step growth stoichiometry. PPF synthesized in this fashion is about 70% lower in molecular weight than other reported synthesis (see e.g., Fisher, J. P.; Holland, T. A.; Dean, D.; Engel, P. S.; Mikos, A. G., J. Biomater. Sci., Polym. Ed. 12, 673 2001, hereby incorporated by reference), however PPF is isolated via a two step synthesis in the previously reported synthesis. PPFcPM synthesized through one step synthesis (Method A) also resulted in polymers with low molecular weights (FIG. 3). In order to increase the Mn of our polyester, a two step synthesis (Method B) was developed. Method B did not produce PPF; it did however, produce the copolymer PPFcPM. The copolymer molecular weight was significantly higher than the copolymer produced using Method A (FIG. 7). The PPFcPM molecular weight using TsOH displayed a Mn of 2,347 and a PDI of 4.85.

Figure 8:
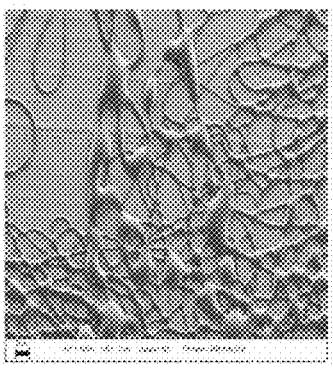
FIG. 8 depicts the effect of 40 wt % PPFcPM in chloroform produced through a two-step synthesis method described herein. The scale bar is 20 um.
Figure 9:
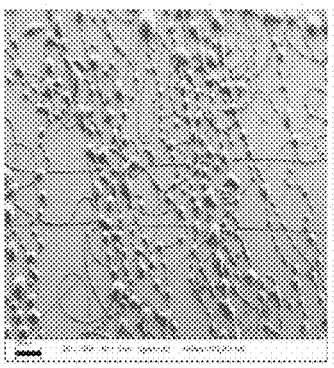
FIG. 9 depicts the effect of 50 wt % PPFcPM in chloroform produced through a two-step synthesis method described herein. The scale bar is 100 um.
Figure 10:
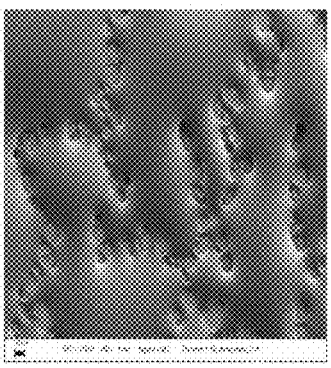
FIG. 10 depicts the effect of 60 wt % PPFcPM in chloroform produced through a two-step synthesis method described herein. The scale bar is 20 um.

To form a network of PPFcPM copolymer fibers, the copolymer was spun using standard electrospinning techniques. Three different solution concentrations ranging from 40 to 60% (w/w) dissolved in chloroform were used to determine the solution concentration that would allow for the production of continuous fibers at 1 kV/cm (FIGS. 8-10). Fibrous mats were not produced when low $T_g$ polymers were electrospun. Instead the polymer self-calendared to form one layer of a porous material. The flow rate was reduced to 0.1 ml/hr from 0.5 ml/hr in hopes of reducing the self-calendaring effect and allow for three dimensional fibrous scaffold formation. Unfortunately even with the reduced flow rate self-calendaring, due to the flow of polymer at RT, was still observed via scanning electron microscopy (SEM) imaging.

In order to produce a fibrous 3D network that did not self-calendar the copolymer was crosslinked using in-situ photopolymerization during the electrospinning process. Crosslinking the polymer before electrospinning was not possible as the polymer would no longer be soluble.

Figure 11:
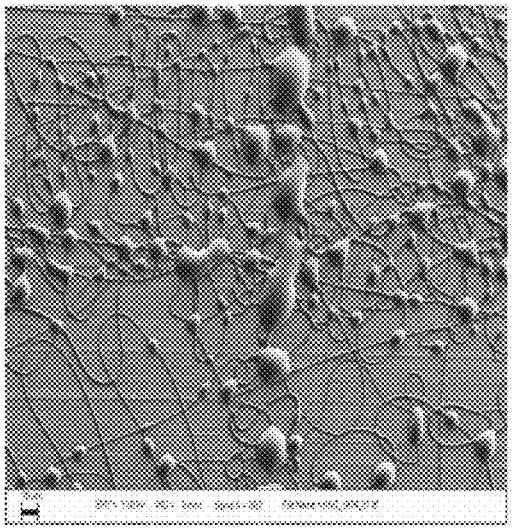
FIG. 11 shows the effect on polymer (50 wt %) after cross linking with Benzil (3 wt %), spun at 15 kV/15 cm and flow rate of 0.1 mL/hr zoomed out on larger area, beads and fibers.
Figure 12:
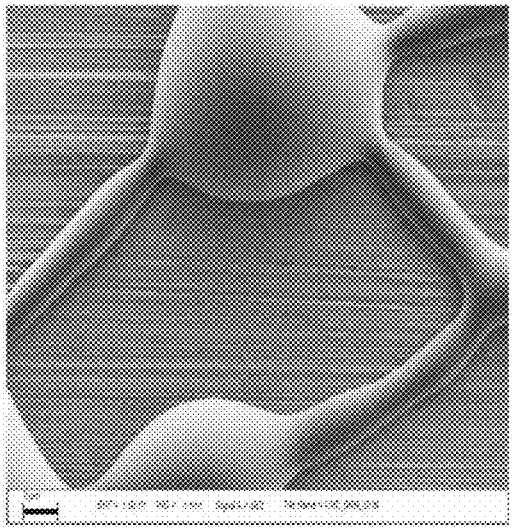
FIG. 12 shows a node-like intersection of the polymer of FIG. 11 where "wetting" occurred.
Figure 13:
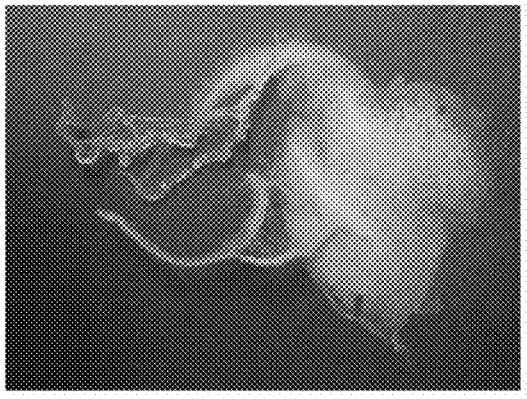
FIG. 13 is a top view of the effect on mat from PPFcPM-BAPO collecting in the same area on the target.
Figure 14:
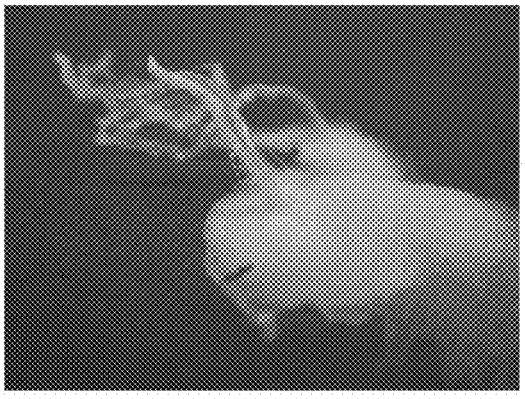
FIG. 14 is a side view of the polymer shown in FIG. 13.

Either benzyl or BAPO was incorporated at 3% (w/w) into a PPFcPM solution (40-60% (w/w)) in chloroform, yielding a solution viscosity of 1863 cP (Brookfield DV-E) at RT. Both solutions were electrospun using the aforementioned parameters and set up. The nano- and microfibers fabricated from a polymer solution containing benzil were exposed to UV light (λ=365 nm) as they were spun and deposited onto the aluminium foil coated copper plate held at ground potential. After deposition the polymer was exposed to UV radiation for an additional 15 min. Fibers produced in this way did not exist as individual fibers but rather as a self calendared layer (FIGS. 11, 12). Presumably too few radicals were produced to initiate photo-crosslinking during fiber formation. PPFcPM/BAPO solutions were loaded in a plastic syringe and electrospun using the same conditions as the polymer/benzyl solution. A fibrous mat was formed using BAPO as the photoinitiator. However, after 0.1 ml of solution was delivered the photo-crosslinked polymer began to form pillars (FIGS. 13, 14).

In order to determine the cause of the pillar formation, a temperature mapping of the aluminum foil coated plate was performed by splitting the aluminum foil into a 3×3 array of 2" squares to form a total of nine regions. Using an IR thermometer, the temperature was recorded in each of the regions to determine if the UV lamp was locally heating the aluminum surface, potentially leading to pillar formation.

Figure 15:
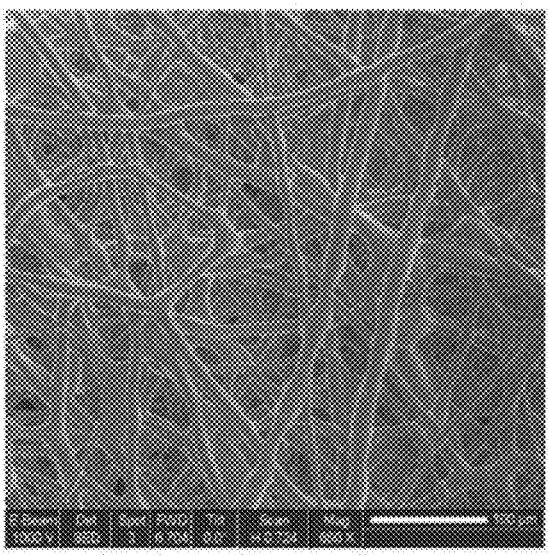
FIG. 15 depicts 50 wt % PPFcPM, 3 wt % BAPO in CHCL3. Scale bar is 100 um.
Figure 16:
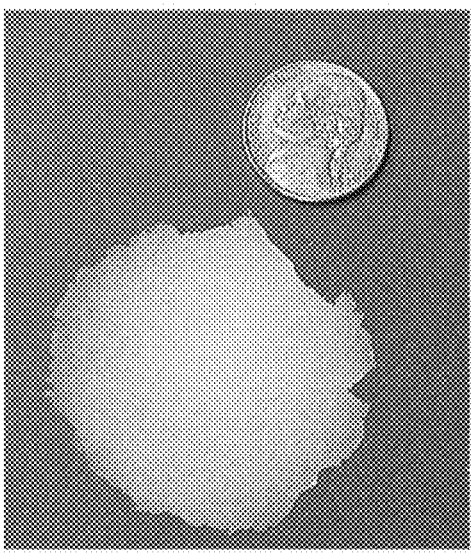
FIG. 16 shows a mat of the SEM image seen in FIG. 15.

No local heating of the surface was observed over a typical period of electrospun fiber deposition. Further examination of the electrospinning apparatus revealed that the UV radiation was being reflected off of the aluminum foil exposing the PPFcPM/BAPO filled syringe, promoting photo-cross-linking of the polymer solution altering the solution viscosity. However, when the syringe was shielded from the reflected UV radiation the PPFcPM/BAPO was spun successfully and produced a non-calendared mat, free of pillar formation (FIGS. 15, 16). Using ImageJ, 30 random fibers in the SEM image were measured to determine the average fiber-diameter per sample. With the PPFcPM/BAPO conditions described above, fibers with diameters of 6.94±3.64 μm were formed. The Tg of the polymers prior to crosslinking did not significantly affect the structure of the electrospun fibers formed as they were crosslinked in-situ.

What is claimed is:

1. A method for forming non-woven fiber mats comprising:

mixing a low molecular weight polymer or monomer precursor with a cross-linking agent to form a solution; wherein the low molecular weight polymer precursor is selected from the group consisting of: Poly (propylene-fumarate)-co-(propylene maleate); (PPFcPM); Poly (Butylene-fumarate) (PBF); and Poly (Butylene-fumarate)-co(butylene maleate) (PBFcBM) or a combination of the above polymers;

forming a fiber from the solution by directing the solution through an electric field towards a target; and directing a photon source at the fibers as they are formed and at the target so as to crosslink the solution in situ.

2. The method of claim 1 wherein the low molecular weight polymer or monomer precursor has a low $T_m$.

3. The method of claim 1 wherein the low molecular weight polymer or monomer precursor has a low $T_g$.

4. The method of claim 1 wherein the low molecular weight polymer or monomer precursor has a molecular weight below 10,000.

5. The method of claim 1 wherein the low molecular weight polymer or monomer precursor has a molecular weight below 6,000.

6. The method of claim 1 wherein the low molecular weight polymer or monomer precursor is unmodified.

7. The method of claim 1 wherein the combination of low molecular weight polymer precursors further comprises Poly (propylene-fumerate) (PPF).

8. The method of claim 1 wherein the low molecular weight polymer precursor is PPFcPM, and the method further comprises synthesizing the PPFcPM via step growth polycondensation reactions.

9. The method of claim 1 wherein the solution is contained within a reservoir and the reservoir is shielded from the target such that photons from the photon source do not affect the contents of the reservoir.

10. A method comprising:

providing a system for forming non-woven fiber mats comprising:

a textile formation setup comprising a voltage supply, a reservoir and a target; and a photon source positioned between the reservoir and the target and directed at the target, wherein the reservoir is shielded from the target such that photons from the photon source do not affect the contents of the reservoir;

placing a solution comprising a low molecular weight polymer or monomer precursor and a cross-linking agent in the reservoir; wherein the low molecular weight polymer precursor is selected from the group consisting of: Poly (propylene-fumarate)-co-(propylene maleate); (PPFcPM); Poly (Butylene-fumarate) (PBF); and Poly (Butylene-fumarate)-co(butylene maleate) (PBFcBM); or a combination of the above polymers;

producing a photon field with the photon source; and directing the solution through the photon source and towards a target so as to crosslink the solution in situ.

11. The method of claim 10 wherein the solution consists of the low molecular weight polymer or monomer precursor and a cross-linking agent.

12. The method of claim 10 wherein the combination of low molecular weight polymer precursors further comprises Poly (propylene-fumerate) (PPF).

13. The method of claim 11 wherein the low molecular weight polymer or monomer precursor has a molecular weight below 10,000.

14. The method of claim 11 wherein the low molecular weight polymer or monomer precursor has a molecular weight below 6,000.

15. The method of claim 11 wherein low molecular weight polymer or monomer precursor has a low $T_m$ and/or a low $T_g$.

16. The method of claim 7 wherein the low molecular weight polymer precursor comprises PPF and the method further comprises synthesizing the PPF via step growth polycondensation reactions.

* * * * *